US006186552B1

(12) United States Patent
Seabrook

(10) Patent No.: US 6,186,552 B1
(45) Date of Patent: Feb. 13, 2001

(54) CHANGEABLE MEMORANDUM WRISTBAND

(76) Inventor: Avis Y. Seabrook, 1025 NE. 2nd Ave. P.O. Box 489, Williston, FL (US) 32696

( * ) Notice: Under 35 U.S.C. 154(b), the term of this patent shall be extended for 0 days.

(21) Appl. No.: 09/548,241

(22) Filed: Apr. 12, 2000

(51) Int. Cl.[7] ..... G09F 3/14; G09D 3/10

(52) U.S. Cl. ..... 281/45; 40/633; 40/640; 40/665; 40/669; 40/304

(58) Field of Search ..... 40/633, 640, 665, 40/669, 304; 281/45

(56) References Cited

U.S. PATENT DOCUMENTS

| | | | | |
|---|---|---|---|---|
| 1,657,250 | * | 1/1928 | Fetters | 40/633 |
| 2,073,280 | * | 3/1937 | Lederer | 40/156 |
| 3,330,057 | * | 7/1967 | Rodgers | 40/21 |
| 3,526,985 | * | 9/1970 | Rieth | 40/117 |
| 3,698,113 | * | 10/1972 | Spicer | 40/118 |
| 3,769,726 | * | 11/1973 | Spence | 40/21 C |
| 3,864,856 | * | 2/1975 | McManus | 40/21 |
| 4,377,047 | * | 3/1983 | Adams, Jr. et al. | 40/21 C |
| 5,092,067 | * | 3/1992 | Prout | 40/633 |

* cited by examiner

*Primary Examiner*—A. L. Wellington
*Assistant Examiner*—Mark T. Henderson

(57) ABSTRACT

A changeable memorandum wristband for reminding the user of appointments, phone calls, and other tasks needed to be done. The changeable memorandum wristband includes a wristband member having ends and a plurality of holes spaced apart and extending along a portion of the wristband member near a first one of the ends and also having a buckle member securely attached to a second one of the ends for fastening the wristband member about a user's wrist; and also includes a memorandum support member securely mounted to the wristband member and having mounting brackets extending from ends thereof and also having a face on a top thereof and further having elongate wristband mounting members securely mounted to the mounting brackets and being spaced from the ends of the memorandum support member with the wristband member being received between the ends of the memorandum support member and the elongate wristband mounting members; and further includes a cover member hingedly attached to the memorandum support member and being closeable over the face thereof; and also includes a memorandum recording member removably and securely disposed upon the face of the memorandum support member.

7 Claims, 2 Drawing Sheets

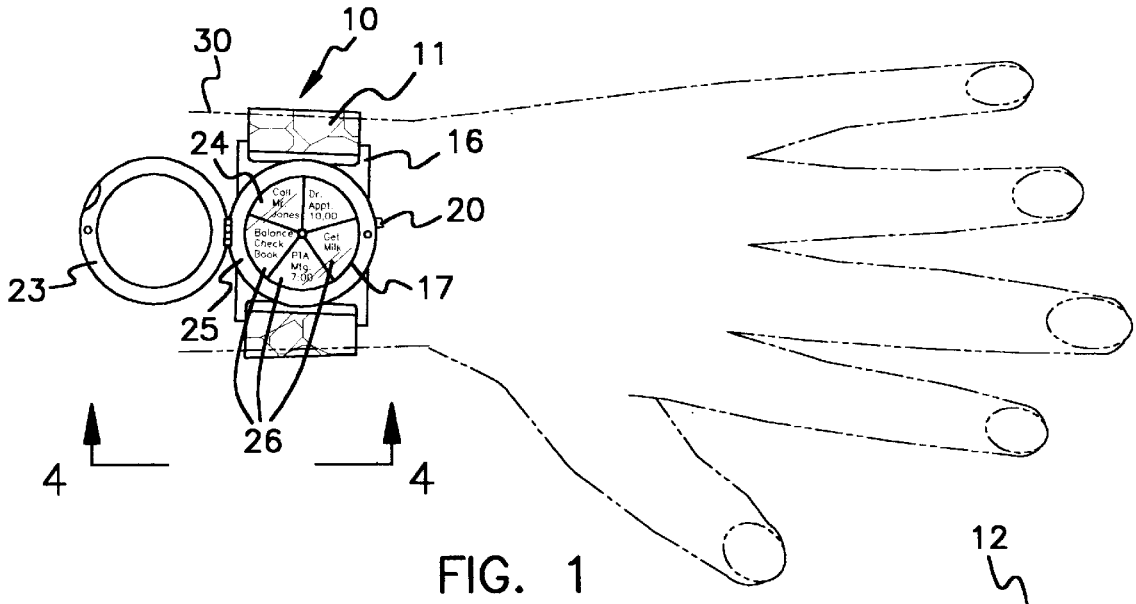
FIG. 1
FIG. 3
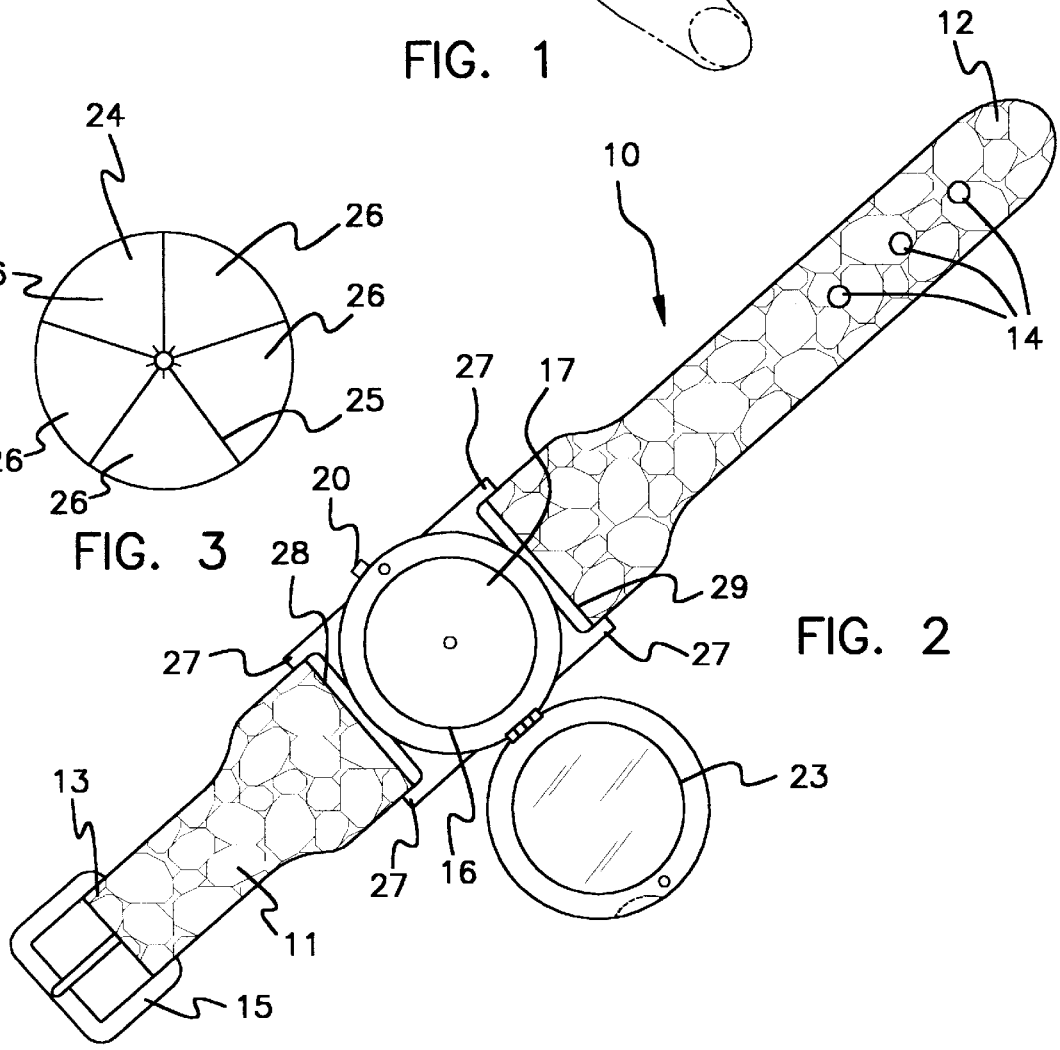
FIG. 2

CHANGEABLE MEMORANDUM WRISTBAND

BACKGROUND OF THE INVENTION

1. Field of the Invention

The present invention relates to a memory band and more particularly pertains to a new changeable memorandum wristband for reminding the user of appointments, phone calls, and other tasks needed to be done.

2. Description of the Prior Art

The use of a memory band is known in the prior art. More specifically, a memory band heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,407,239; U.S. Pat. No. 4,906,025; U.S. Pat. No. 3,739,740; U.S. Pat. No. 4,179,833; U.S. Pat. No. 2,553,676; and U.S. Pat. No. Des. 76,777.

While these devices fulfill their respective, particular objectives and requirements, the aforementioned patents do not disclose a new changeable memorandum wristband. The inventive device includes a wristband member having ends and a plurality of holes spaced apart and extending along a portion of the wristband member near a first one of the ends and also having a buckle member securely attached to a second one of the ends for fastening the wristband member about a user's wrist; and also includes a memorandum support member securely mounted to the wristband member and having mounting brackets extending from ends thereof and also having a face on a top thereof and further having elongate wristband mounting members securely mounted to the mounting brackets and being spaced from the ends of the memorandum support member with the wristband member being received between the ends of the memorandum support member and the elongate wristband mounting members; and further includes a cover member hingedly attached to the memorandum support member and being closeable over the face thereof; and also includes a memorandum recording member removably and securely disposed upon the face of the memorandum support member.

In these respects, the changeable memorandum wristband according to the present invention substantially departs from the conventional concepts and designs of the prior art, and in so doing provides an apparatus primarily developed for the purpose of reminding the user of appointments, phone calls, and other tasks needed to be done.

SUMMARY OF THE INVENTION

In view of the foregoing disadvantages inherent in the known types of memory band now present in the prior art, the present invention provides a new changeable memorandum wristband construction wherein the same can be utilized for reminding the user of appointments, phone calls, and other tasks needed to be done.

The general purpose of the present invention, which will be described subsequently in greater detail, is to provide a new changeable memorandum wristband which has many of the advantages of the memory band mentioned heretofore and many novel features that result in a new changeable memorandum wristband which is not anticipated, rendered obvious, suggested, or even implied by any of the prior art memory band, either alone or in any combination thereof.

To attain this, the present invention generally comprises a wristband member having ends and a plurality of holes spaced apart and extending along a portion of the wristband member near a first one of the ends and also having a buckle member securely attached to a second one of the ends for fastening the wristband member about a user's wrist; and also includes a memorandum support member securely mounted to the wristband member and having mounting brackets extending from ends thereof and also having a face on a top thereof and further having elongate wristband mounting members securely mounted to the mounting brackets and being spaced from the ends of the memorandum support member with the wristband member being received between the ends of the memorandum support member and the elongate wristband mounting members; and further includes a cover member hingedly attached to the memorandum support member and being closeable over the face thereof; and also includes a memorandum recording member removably and securely disposed upon the face of the memorandum support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new changeable memorandum wristband which has many of the advantages of the memory band mentioned heretofore and many novel features that result in a new changeable memorandum wristband which is not anticipated, rendered obvious, suggested, or even implied by any of the prior art memory band, either alone or in any combination thereof.

It is another object of the present invention to provide a new changeable memorandum wristband which may be easily and efficiently manufactured and marketed.

It is a further object of the present invention to provide a new changeable memorandum wristband which is of a durable and reliable construction.

An even further object of the present invention is to provide a new changeable memorandum wristband which is susceptible of a low cost of manufacture with regard to both materials and labor, and which accordingly is then susceptible of low prices of sale to the consuming public, thereby making such changeable memorandum wristband economically available to the buying public.

Still yet another object of the present invention is to provide a new changeable memorandum wristband which provides in the apparatuses and methods of the prior art some of the advantages thereof, while simultaneously overcoming some of the disadvantages normally associated therewith.

Still another object of the present invention is to provide a new changeable memorandum wristband for reminding the user of appointments, phone calls, and other tasks needed to be done.

Yet another object of the present invention is to provide a new changeable memorandum wristband which includes a wristband member having ends and a plurality of holes spaced apart and extending along a portion of the wristband member near a first one of the ends and also having a buckle member securely attached to a second one of the ends for fastening the wristband member about a user's wrist; and also includes a memorandum support member securely mounted to the wristband member and having mounting brackets extending from ends thereof and also having a face on a top thereof and further having elongate wristband mounting members securely mounted to the mounting brackets and being spaced from the ends of the memorandum support member with the wristband member being received between the ends of the memorandum support member and the elongate wristband mounting members; and further includes a cover member hingedly attached to the memorandum support member and being closeable over the face thereof; and also includes a memorandum recording member removably and securely disposed upon the face of the memorandum support member.

Still yet another object of the present invention is to provide a new changeable memorandum wristband that can be conveniently worn about the wrist like that of a wristwatch.

Even still another object of the present invention is to provide a new changeable memorandum wristband that conveniently sections off the things that the user needs to do for that day.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top plan view of a first embodiment of a new changeable memorandum wristband according to the present invention and shown in use.

FIG. 2 is a top plan view of the first embodiment of the present invention.

FIG. 3 is a top plan view of the memorandum recording member of the first embodiment of the present invention.

DESCRIPTION OF THE PREFERRED EMBODIMENT

Figure 4:
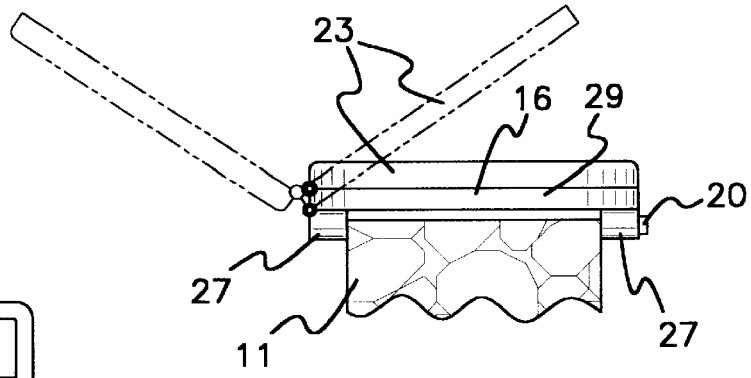
FIG. 4 is an end elevational view of the first embodiment of the present invention.
Figure 5:
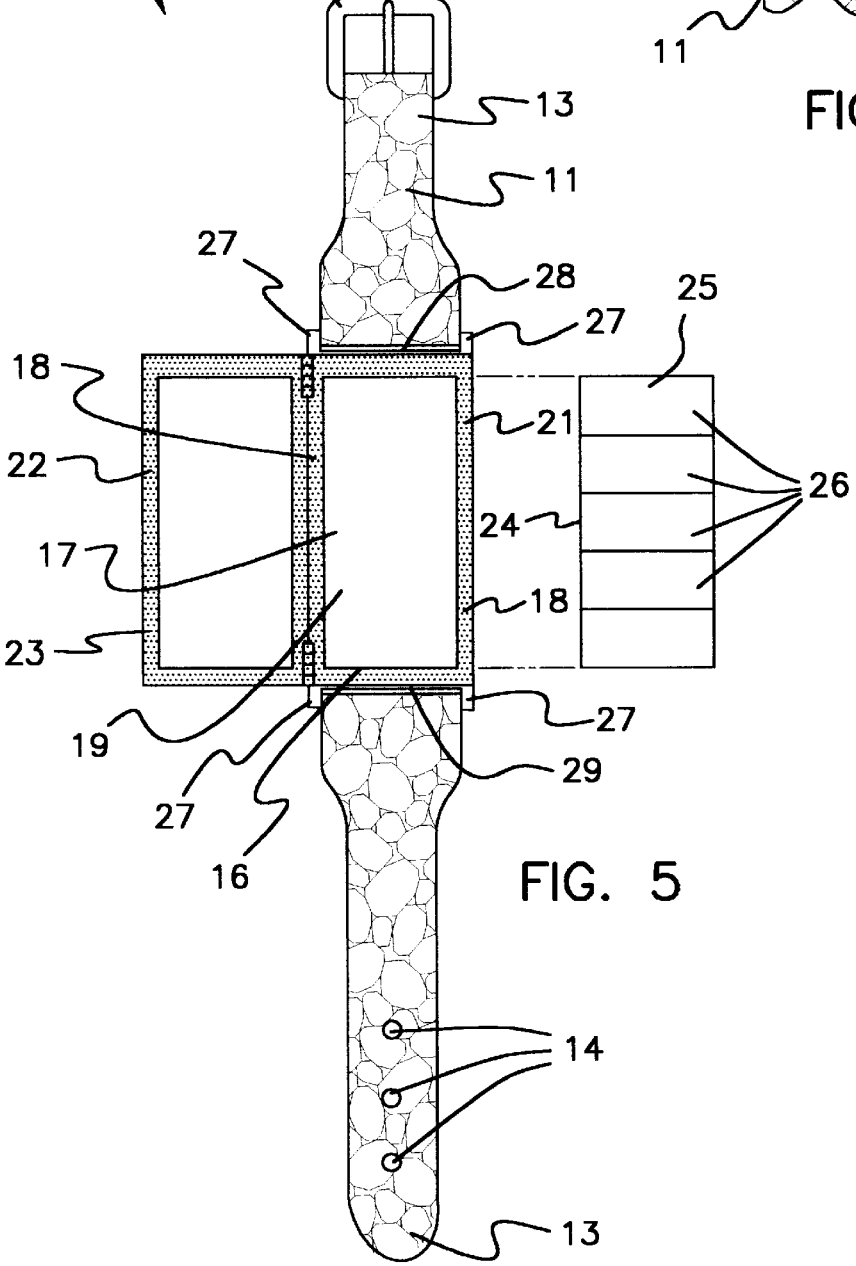
FIG. 5 is a top plan view of the second embodiment of the present invention.

With reference now to the drawings, and in particular to FIGS. 1 through 5 thereof, a new changeable memorandum wristband embodying the principles and concepts of the present invention and generally designated by the reference numeral 10 will be described.

As best illustrated in FIGS. 1 through 5, the changeable memorandum wristband 10 generally comprises a wristband member 11 having ends 12,13 and a plurality of holes 14 spaced apart and extending along a portion of the wristband member 11 near a first one 12 of the ends and also having a buckle member 15 securely and conventionally attached to a second one 13 of the ends for fastening the wristband member 11 about a user's wrist 30. A memorandum support member 16 is securely and conventionally mounted to the wristband member 11 and has mounting brackets 27 conventionally extending from ends thereof and also has a face 17 on a top thereof and further has elongate wristband supporting members 28,29 securely and conventionally mounted to the mounting brackets 27 and being spaced from the ends of the memorandum support member 16 with the wristband member 11 being securely and conventionally attached to the elongate wristband supporting members 28,29. A cover member 23 is hingedly attached to the memorandum support member 16 and is closeable over the face 17 thereof. The memorandum support member 16 includes a latching means 20–22 for locking and releasing the cover member 23 from upon the face 17 of the memorandum support member 16. A memorandum recording member 24 is removably and securely disposed upon the face 17 of the memorandum support member 16 with the memorandum recording member 24 including a writing and erasable surface 25 which is divided into a plurality of distinctive sections 26. Each of the distinctive sections 26 is adapted to be written upon and to record readable messages for a user. As a first embodiment, the writing and erasing surface 25 of the memorandum recording member 24 is essentially circular with the memorandum recording member 24 being a thin piece of material and being adapted to be securely and removably disposed upon the face 17. Also as a first embodiment, the latching means 20–22 includes a depressible button 20 movably and conventionally disposed in a side wall of the memorandum support member 16 with the memorandum support member 16 being essentially disc-shaped with the face 17 being circular.

As a second embodiment, the latching means 20–22 includes strips of hook and loop fasteners 21,22 securely and conventionally attached along a bottom edge of the cover member 23 and along a perimeter of the face 17 of the memorandum support member 16 with the memorandum support member 16 being essentially rectangular and having a bottom wall 19, side walls 18, and an open top. Also, as a second embodiment, the memorandum recording member 24 is a rectangular strip of a thin piece of material and being adapted to be securely and removably disposed upon the bottom wall 19 of the rectangular memorandum support member 16.

In use, the user uses a marker such as a water-based marker to clearly and legibly write messages upon the sections 26 of the memorandum recording member 24 and then places the memorandum recording member 24 upon the face 17 of the memorandum support member 16 which is securely mounted to the wristband member 11 which can be worn comfortably about the wrist 30 of the user just like that of wristwatch with the messages reminding the user of the various tasks he/she must do for the day.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A changeable memorandum wristband comprising:

a wristband member having ends and a plurality of holes spaced apart and extending along a portion of said wristband member near a first one of said ends and also having a buckle member securely attached to a second one of said ends for fastening said wristband member about a user's wrist;

a memorandum support member securely mounted to said wristband member and having mounting brackets extending from ends thereof and also having a face on a top thereof and further having elongate wristband supporting members securely mounted to said mounting brackets and being spaced from said ends of said memorandum support member with said wristband member being securely attached to said elongate wristband mounting members;

a cover member hingedly attached to said memorandum support member and being closeable over said face thereof; and a memorandum recording member removably and securely disposed upon said face of said memorandum support member;

wherein said memorandum support member includes a latching means for locking and releasing said cover member from upon said face of said memorandum support member; and wherein said latching means includes a depressible button movably disposed in a side wall of said memorandum support member.

2. A changeable memorandum wristband as described in claim 1, wherein said memorandum recording member includes a writing and erasable surface which is divided into a plurality of distinctive sections, each of said distinctive sections being adapted to be written upon and to record readable messages for a user.

3. A changeable memorandum wristband as described in claim 1, wherein said memorandum support member is essentially disc-shaped with said face being circular.

4. A changeable memorandum wristband as described in claim 1, wherein said memorandum support member is essentially rectangular and has a bottom wall, side walls, and an open top.

5. A changeable memorandum wristband as described in claim 3, wherein said writing and erasing surface of said memorandum recording member is essentially circular with said memorandum recording member being a thin piece of material and being adapted to be securely and removably disposed upon said face.

6. A changeable memorandum wristband as described in claim 4, wherein said memorandum recording member is a rectangular strip of a thin piece of material and is adapted to be securely and removably disposed upon said bottom wall of said rectangular memorandum support member.

7. A changeable memorandum wristband comprising:

a wristband member having ends and a plurality of holes spaced apart and extending along a portion of said wristband member near a first one of said ends and also having a buckle member securely attached to a second one of said ends for fastening said wristband member about a user's wrist;

a memorandum support member securely mounted to said wristband member and having mounting brackets extending from ends thereof and also having a face on a top thereof and further having elongate wristband supporting members securely mounted to said mounting brackets and being spaced from said ends of said memorandum support member with said wristband member being securely attached to said elongate wristband supporting members;

a cover member hingedly attached to said memorandum support member and being closeable over said face thereof, said memorandum support member including a latching means for locking and releasing said cover member from upon said face of said memorandum support member, said latching means including a depressible button movably disposed in a side wall of said memorandum support member, said memorandum support member being essentially disc-shaped with said face being circular; and a memorandum recording member removably and securely disposed upon said face of said memorandum support member, said memorandum recording member including a writing and erasable surface which is divided into a plurality of distinctive sections, each of said distinctive sections being adapted to be written upon and to record readable messages for a user, said writing and erasing surface of said memorandum recording member being essentially circular with said memorandum recording member being a thin piece of material and being adapted to be securely and removably disposed upon said face.

* * * * *